US009073167B2

(12) United States Patent
Skoblenick

(10) Patent No.: US 9,073,167 B2
(45) Date of Patent: Jul. 7, 2015

(54) PRECISION RAIL PROFILING DEVICE FOR RAILWAY TURNOUTS AND CROSSINGS

(75) Inventor: Harry Skoblenick, Kingston (CA)

(73) Assignee: Bombardier Transportation GmbH, Berlin (DE)

( * ) Notice: Subject to any disclaimer, the term of this patent is extended or adjusted under 35 U.S.C. 154(b) by 408 days.

(21) Appl. No.: 13/268,188

(22) Filed: Oct. 7, 2011

(65) Prior Publication Data

US 2013/0090046 A1 Apr. 11, 2013

(51) Int. Cl.

| | |
|---|---|
| ***B24B 19/00*** | (2006.01) |
| ***E01B 31/15*** | (2006.01) |
| ***E01B 31/17*** | (2006.01) |
| ***E01B 31/18*** | (2006.01) |
| ***B24B 23/08*** | (2006.01) |

(52) U.S. Cl.

CPC ..... *B24B 19/004* (2013.01); *E01B 31/17* (2013.01); *E01B 31/18* (2013.01); *E01B 31/15* (2013.01); *B24B 23/08* (2013.01)

(58) Field of Classification Search

CPC ..... E01B 31/15; E01B 31/17; E01B 31/18; B24B 19/004; B24B 23/08

USPC ..... 451/28, 49, 54, 347, 429

See application file for complete search history.

(56) References Cited

U.S. PATENT DOCUMENTS

| | | | | | |
|---|---|---|---|---|---|
| 1,933,139 | A | * | 10/1933 | Daley | 29/402.18 |
| 3,377,751 | A | | 4/1968 | Schnyder | |
| 3,708,856 | A | * | 1/1973 | Keifer | 29/402.18 |
| 3,818,650 | A | * | 6/1974 | Behne | 451/57 |
| 3,976,239 | A | * | 8/1976 | Finck | 228/119 |
| 4,416,091 | A | * | 11/1983 | Panetti | 451/347 |
| 4,751,794 | A | * | 6/1988 | Clem | 451/158 |
| 4,817,534 | A | | 4/1989 | Skoblenick et al. | |
| 4,854,088 | A | * | 8/1989 | Clem | 451/28 |
| 4,905,422 | A | * | 3/1990 | Panetti | 451/347 |
| 4,908,993 | A | * | 3/1990 | Buhler | 451/347 |
| 5,575,709 | A | * | 11/1996 | Hertelendi et al. | 451/347 |
| 5,735,734 | A | * | 4/1998 | Hertelendi | 451/347 |

(Continued)

FOREIGN PATENT DOCUMENTS

| | | | |
|---|---|---|---|
| WO | 8802300 | A1 | 4/1988 |
| WO | 2007033763 | A1 | 3/2007 |

OTHER PUBLICATIONS

"09200/09200A Precision Frog Grinder—Data Sheet"; Matweld, Inc.; Paducah, KY; Rev. Jun. 2009.

(Continued)

*Primary Examiner* — Eileen Morgan

(74) *Attorney, Agent, or Firm* — The Webb Law Firm

(57) ABSTRACT

A rail profiling device for a railway crossover includes a frame having first and second rail-side members laterally spaced from each other and two longitudinally spaced support members extending therebetween; a plurality of wheels positioned on the rail-side members, wherein the rail-side members are laterally spaced a distance, such that wheels on opposite rail-side members are configured to be mounted on laterally spaced rails of the railway corresponding to an axle width of a rail vehicle of the railway, the wheels including a wheel profile corresponding to a rail vehicle wheel profile; and a planing device positioned on the first rail-side member and configured to provide, in a single set-up pass, a precisely located continuously levelly supported crossover wheel contact surface profile along the entire length of one side of the railway crossover.

25 Claims, 15 Drawing Sheets

(56) References Cited

U.S. PATENT DOCUMENTS

| | | | | |
|---|---|---|---|---|
| 6,033,291 | A * | 3/2000 | Mathison et al. | 451/57 |
| 6,266,866 | B1 | 7/2001 | Ramirez et al. | |
| 6,663,476 | B1 * | 12/2003 | Story et al. | 451/347 |
| 6,669,533 | B2 * | 12/2003 | Huboud-Peron | 451/11 |
| 6,746,307 | B2 * | 6/2004 | Knoll et al. | 451/5 |
| 6,921,319 | B2 * | 7/2005 | Knoll et al. | 451/56 |
| 7,442,115 | B1 * | 10/2008 | Brenny et al. | 451/65 |
| 8,367,960 | B2 * | 2/2013 | Keefe | 219/54 |
| 2002/0019205 | A1 * | 2/2002 | Huboud-Peron | 451/429 |
| 2003/0129926 | A1 * | 7/2003 | Knoll et al. | 451/28 |
| 2003/0143928 | A1 * | 7/2003 | Knoll et al. | 451/28 |
| 2013/0090046 | A1 * | 4/2013 | Skoblenick | 451/429 |

OTHER PUBLICATIONS

"Geismar—Data Sheet for Frog Grinder".

Cabrera et al.; "Redesign of Frog Geometry at New York City Transit to Reduce Vibration, Noise and Accelerated Wear"; Proceedings of the AREMA 2000 Annual Conferences, Sep. 10-13, 2000; Dallas, TX.

* cited by examiner

PRECISION RAIL PROFILING DEVICE FOR RAILWAY TURNOUTS AND CROSSINGS

BACKGROUND OF THE INVENTION

1. Field of the Invention

The invention relates to a device and methods for profiling railway rails and, more particularly, to a device and methods for vehicle wheel profile-matching railway turnouts and crossings.

2. Description of Related Art

The contact rolling surface found along the length of a standard railway crossing, such as a steel frog or a diamond crossing, has been pre-defined for many years. When a vehicle passes through a typical rail crossover, the wheels pass over a raised wing surface, which is designed to support and maintain the wheel profile for a relatively level passage. Rail crossover, as used herein, means a rail turnout or crossing allowing a rail vehicle to be guided from one set of rails to another. Insert and solid steel frog designs have been supplied for many years and are used by every major railway. Very little advancement has taken place with regard to technology designed to precisely match an existing rail crossover to a specific existing vehicle wheel profile or to alternate wheel profiles. Vehicle wheel widths and tapered tread profiles are often custom designed to suite a particular transit operator's requirements. As a result, when a standard crossover design is installed, oftentimes the transfer surfaces are not continuously levelly supported through the entire length of the crossover casting. Without matching the crossover profile to the wheel requirements, level rolling discontinuities often result in dropping of the wheel tread surface, thereby, imparting high impacted forces and accelerated wear/damage to the track and vehicle bogie system. Bogie impact forces from as little as 5 mm of height have resulted in up to 30-40 G of impact force during higher vehicle operating speeds and significantly have reduced operating life expectancy for track and vehicle components.

When field repair is required on a damaged crossover, rolling surface areas are built-up through a special certified welding process and the profile manually shaped back to the original (usually flat) profile with a hand grinder. The finished surface contour is usually visually inspected with a straight edge to verify that the finished product is returned as close as possible to the original rail surface contour. Without a technique to accurately apply and precisely shape the length of the crossover to a fully level supported "wheel tread matching" profile, and without an accurate means to quickly and easily verify an alternate properly supporting profile has been provided, rolling axle instability due to wheel passage and track/equipment wear will continue to occur.

Typical technology used to shape the crossover surface after welding includes grinding by use of a hand grinder or portable grinding platforms that are either secured directly over the crossover casting or are guided to provide a flat and level profile over a relatively short linear path. However, after grinding a section, the finished surface is only visually inspected and checked with a straight edge or simple hand tools to ensure reworked sections are uniform with no surface gaps present. These methods do not apply to a revised raised wing or point sections to better support the transfer of the wheel path. Therefore, wheel load impacts are not prevented, only maintained at a lower level after rework. This results in less accurate correction to the surface profiles of the crossovers with limited verification. Often, surface discontinuities are still present after modification resulting again with initially lower impact forces. The previously used methods included minor modifications, which failed to correct the source of the impact forces.

These high impact forces have often led to the reduction of operating speeds through crossovers and continuous repair and maintenance for both vehicles and rails. The cost and time required to routinely repair rail crossovers is an ongoing concern.

There exists a need for a precision and efficient method and device to greatly eliminate impact forces due to imperfectly matched rail crossover profiles and vehicle wheel profiles.

SUMMARY OF THE INVENTION

A rail profiling device for a railway crossover may include a frame having a first rail-side member and a second rail-side member laterally spaced from each other and two longitudinally spaced support members extending between the rail-side members; a plurality of wheels positioned on and extending from the rail-side members, wherein the rail-side members are laterally spaced a distance, such that wheels on opposite rail-side members are configured to be mounted on laterally spaced rails of the railway corresponding to an axle width of a rail vehicle of the railway, the wheels comprising a wheel profile corresponding to a wheel profile of the rail vehicle; and a metal planing device, which may optionally be powered, positioned on the first rail-side member and configured to provide, in a single set-up pass, a crossover wheel contact surface profile along the entire length of one side of the railway crossover, the wheel contact surface profile corresponding to the rail vehicle wheel profile. The planing device may be pivotable with respect to the first rail-side member. Further, the rail profiling device may include a calibration shoe extending from the first side-rail member and positioned at an angle corresponding to the rail vehicle wheel profile, wherein, prior to operation, the planing device is configured to be positioned over the calibration shoe to pivot the planing device at an angle equal to the calibration shoe angle. The planing device may also include a grinding head, which may optionally be detachably connected to the planing device, such as a replaceable grinding head. The planing device may include four degrees of freedom, including lateral movement, longitudinal movement, vertical movement, and rotational movement. A guide rail may be positioned on a top surface of the first rail-side member, wherein the planing device is positioned in slidable engagement with the guide rail, such that the planing device can slide longitudinally along it. The guide rail may be at least 0.5 meter in length to suit any crossover design. The longitudinally spaced support members may be adjustable such that the wheels are configured to be mounted on laterally spaced rails of varying gauges. The wheels may be frusto-conically shaped, such that they conically diverge at the same angle as the wheel profile of the rail vehicle. The rail profiling device may also include rail locks positioned on the first rail-side member to lock and hold down the frame to the railway rails. Further, the rail profiling device may include a utility platform positioned between the rail-side members and/or rail alignment members extending from the second rail-side member. The rail alignment members may include an elongated body having two extensions positioned perpendicularly thereto, wherein the extensions have at least one guide wheel attached, and the rail alignment member is rotatable from an upward position to downward locked position, wherein the extensions and guide wheels are adapted to maintain the frame and wheels in a precise lateral position which matches the passage of the vehicle wheels. When two guide wheels are present, the extensions and guide wheels are adapted to straddle a portion of the railway rail. The plurality of wheels may comprise removable wheels, which may be interchangeable with wheels of varying wheel profiles. Additionally, the rail profiling device may include a plurality of caster guide wheels attached to the frame, wherein, when the frame is disengaged with a railway rail, the caster guide wheels are configured to transport the frame across a surface. The caster guide wheels may also be pivotable about the frame.

A further embodiment of a rail profiling device for a railway crossover may include a frame having a first rail-side member and a second rail-side member laterally spaced from each other and two longitudinally spaced support members extending between the rail-side members; a plurality of wheels positioned on and extending from the rail-side members, wherein the rail-side members are laterally spaced at a distance, such that wheels on opposite rail-side members are configured to be mounted on laterally spaced rails of the railway corresponding to an axle width of a rail vehicle of the railway, the wheels comprising a frusto-conical wheel profile conically diverging at an angle equal to an angle at which a wheel profile of the rail vehicle conically diverges, wherein the longitudinally spaced support members are adjustable such that the wheels are configured to be mounted on laterally spaced rails of varying gauges; a grinding head positioned on and in pivotable engagement with the first rail-side member and configured to provide, in a single set-up pass, a crossover wheel contact surface profile along the entire length of one side of the railway crossover, the wheel contact surface profile corresponding to the rail vehicle wheel profile; and a calibration shoe extending from the first side-rail member and positioned at an angle corresponding to the rail vehicle wheel profile, wherein, prior to operation, the grinding head is configured to be positioned over the calibration shoe and pivoted at an angle equal to the calibration shoe angle.

A method of profiling a railway crossover may include the steps of determining a matched angle of taper across the width of a rail vehicle wheel; applying a raised weld section to a top of a wing, and, optionally, point, if required, of a railway crossover; and planing the raised weld section to the angle of taper creating a wheel matched profile. The wing portion may be a wing portion of a steel frog within the railway turnout. The method may also include applying a raised weld section to a portion of the frog point. Optionally, verification of the rail crossover profile may be completed after planing. Verifying may include verifying the rail crossover profile by positioning a plurality of inspection templates, which may optionally be rigid, across the length of the rail crossing or rolling a device having wheels with a wheel profile having an angle of taper equal to the angle of taper of the rail vehicle wheel through the railway crossover. The method may also include providing a calibration shoe on the device extending from the device at the defined angle of taper, and, pivoting, prior to the step of planing, a planing tool located on the device against the calibration shoe, such that the grinding head is positioned at the angle of taper. Prior to the planing, the device may be locked in a stationary position on the railway rails, such as by rail locks located on the device. Planing of the rail crossover may include grinding the raised weld band across a length of the wing portion. Prior to the applying the raised weld band, the method may include creating a three-dimensional surface contour model of the turnout by replicating a standard crossover profile; creating a wheel profile model that matches a wheel profile for a rail vehicle of the railway; defining wheel contact surface for the rail vehicle by transposing the wheel profile model over the standard turnout surface contour model; and modeling a raised weld section to be placed along the wheel contact surface. The rail crossover may be a diamond crossover having four rail crossings, wherein the steps of applying a raised weld band, and planing the raised weld band are repeated for each of the four rail crossings.

DESCRIPTION OF THE PREFERRED EMBODIMENTS

For purposes of description hereinafter/orientation terms if used shall relate to the referenced embodiments as it is contained in the accompanying drawing figures or otherwise described in the following detailed description. However, it is to be understood that the embodiments described hereinafter may assume many alternative variations and embodiments and that specific embodiments illustrated in the accompanying drawing figures, and described herein, are simply exemplary and should not be considered as limiting.

Figure 1:
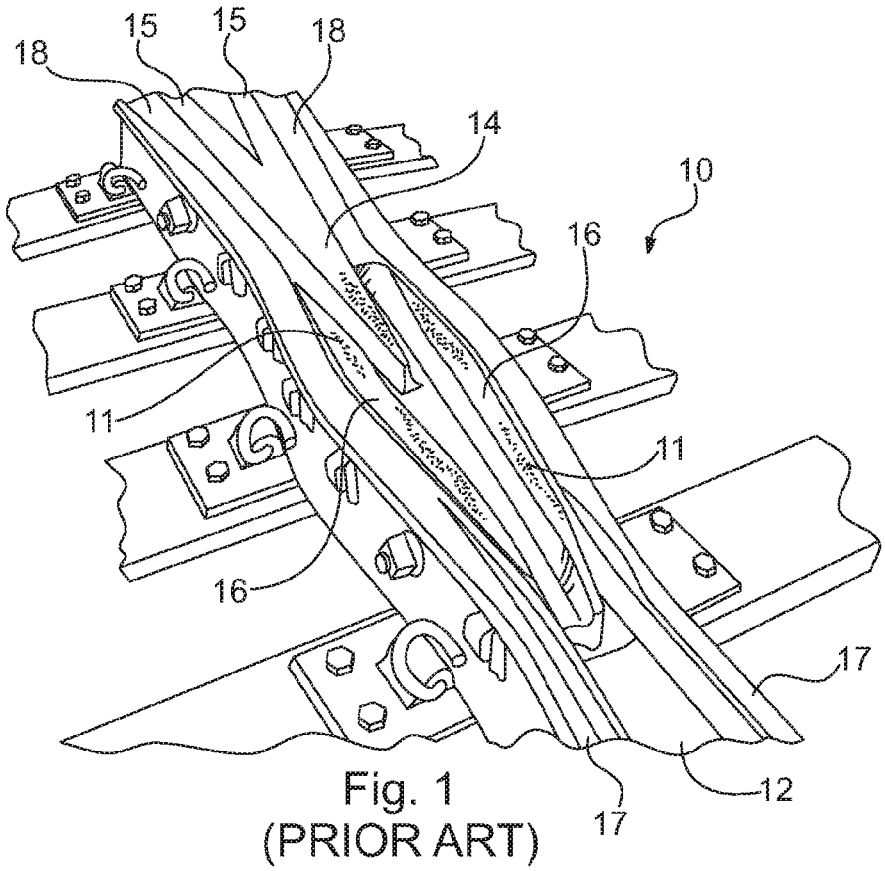
Fig. 1 (PRIOR ART)
FIG. 1 is a perspective view of a used rail frog showing wear.
Figure 2:
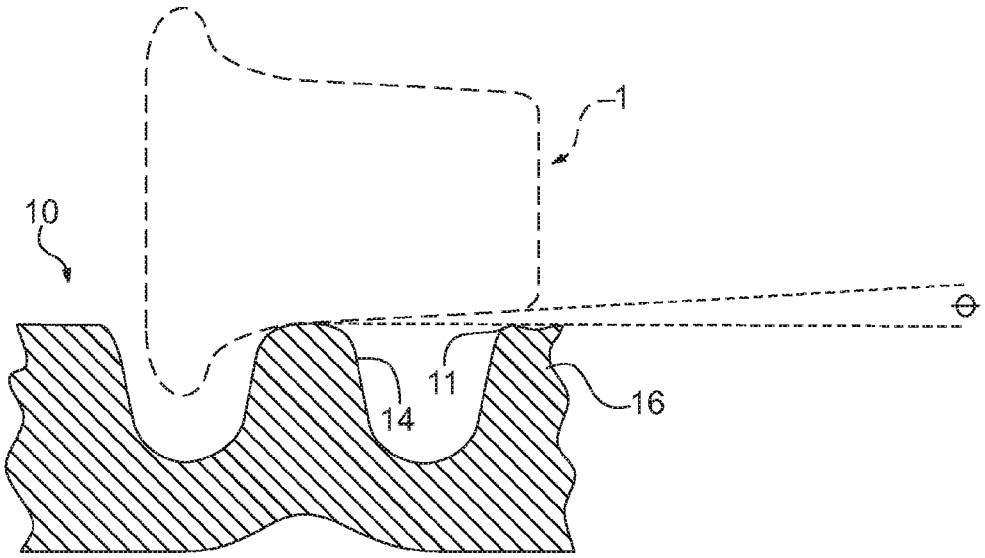
Fig. 2 (PRIOR ART)
FIG. 2 is a cross-sectional of a standard rail frog.

Referring now to FIG. 1, a typical rail steel frog 10, which is normally constructed of manganese steel, is illustrated. A frog 10 normally will include a point 14, two wings 16 located on either side of the point 14, a throat 12, and two flangeway channels 18 along either side of the point 14. Two heel rails 15 extend from an end of the frog 10 leading into the point 14, and two opposite wing rails 17 extend from the wings 16. In operation a rail vehicle wheel will pass from, for example, the left heel rail 15 through the point 14 and onto the opposite right side wing 16, and onto an opposite wing rail 17. Because oftentimes, standard frogs are not optimized for the rail systems in which they are installed or the wheel profile on which they will be operated, dropping of the rail vehicle wheels can result, thereby, imparting high impacted forces and accelerated wear/damage 11 to the track and vehicle bogie system. This is due to the fact that transfer surfaces across point 14 and wings 16 do not continuously support, in a level manner, the wheel profiles of the particular rail vehicles that pass through the frog 10. Also, rail vehicle wheels are often constructed of a material, such as steel, which may have hardness higher than that of a repaired steel frog. Therefore, minimal damage is done to the rail vehicle wheels, while the frogs receive very high amounts of wear/damage. As shown in FIG. 2, a typical rail vehicle wheel 1 is frusto-conical in shape having an angle of taper θ, which is the angle at which the wheel 1 conically diverges. The angle θ may vary depending on the particular rail installation which is in need of repair. The angle θ also may vary slightly due to an amount of lateral movement which is permitted laterally along a wheel axle. The angle θ may be, for example, between 0° and 10°, or preferably between, 2.4° and 4.0°, such as 3.6°. Generally, the wings 16 are not shaped, such as to correspond to the angle θ of the rail vehicle wheel 1 profile. This lack of corresponding profile causes the wheel 1 to drop and impact onto the point 14, prior to the point of level transfer, and the wheel 1 will be forced to climb back up, thereby causing the wear/damage 11, as shown in FIG. 1. Replacement rail frogs are available that are custom designed prior to installation that include profiles that corresponds to rail vehicle wheel profiles of the particular rail lines with which they are to be associated, but such frogs are very expensive and time consuming to install. The below described methods and device make it possible to repair existing non-profile matched frogs to the particular rail line, and, therefore, the rail vehicle wheels with which the frogs are associated.

Figure 3:
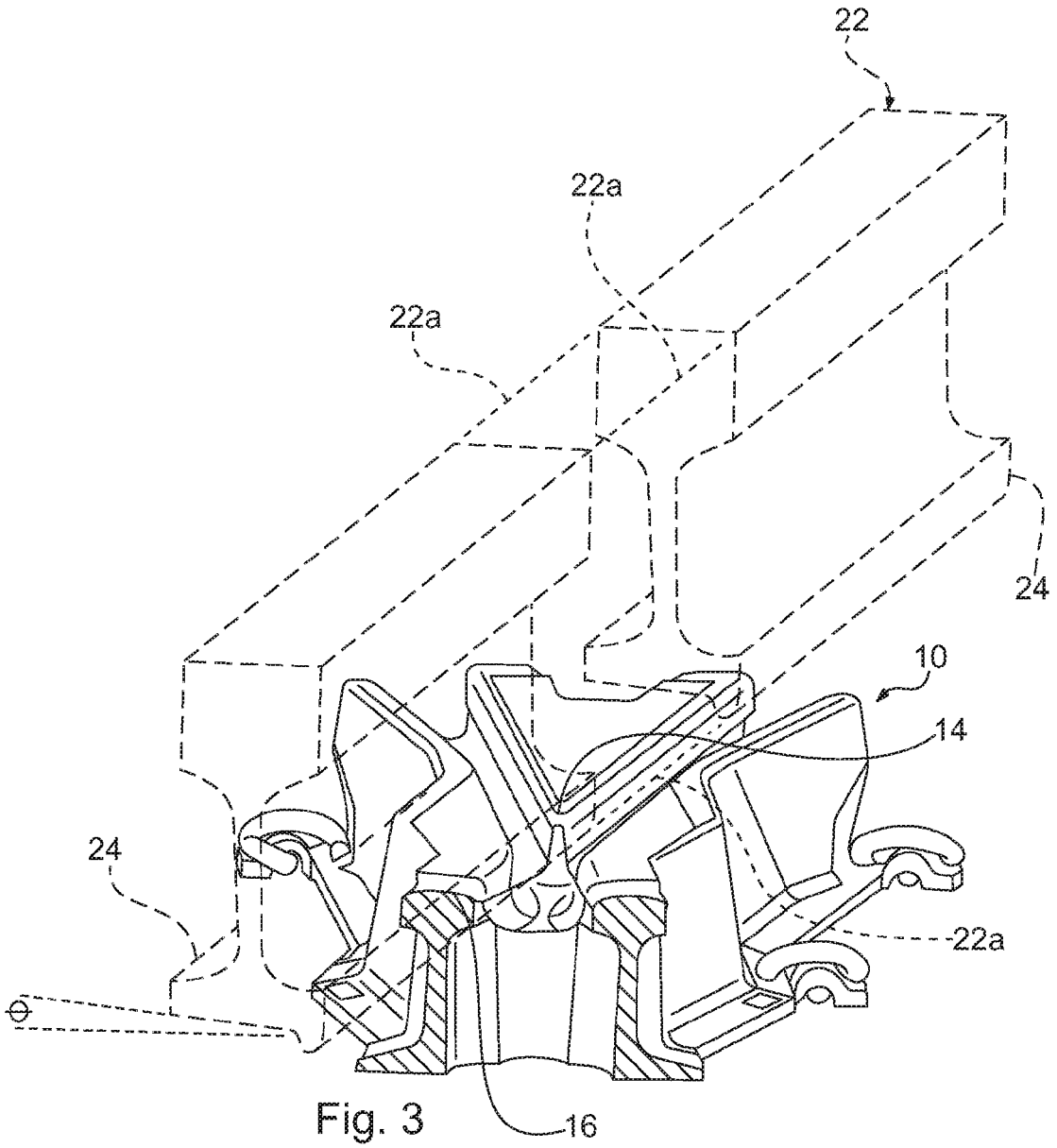
FIG. 3 is a partial cross-sectional view schematic view of a frog with a modeled wheel profile.

Referring now to FIG. 3, a model 20 of a wheel profile 22 through frog 10 is shown. In order to properly determine the correct contact areas of the wheel 1 with the frog 10, a model 20 can be generated, such as by 3-dimensional surface contour computer modeling. As shown, the modeled wheel profile 22 can be an extruded wheel profile that matches exactly the particular wheel 1 and running path to be studied and its tapered surface having an angle of taper θ. The "extruded" profile 22 may take the form of a beam having a lower cross section 24, which corresponds to a cross section of a wheel, such as wheel 1, shown in FIG. 2. For example, the lower cross section 24 of the beam could be a wheel which has been "unrolled" on itself. The lower cross section 24 is then extended for the entire length of the frog 10 spanning the transfer point at the throat 12. For clarity, this is illustrated by showing modeled wheel profile 22, as two segments connected by lines 22*a* indicating that during modeling a single beam wheel profile 22 will extend the entire length of the frog 10. In this manner, the point of contact of the wheel 1 across the entire length of the frog 10 can be examined through cross-sections. From the model 20, adjustments can be made to a modeled frog based on the frog 10.

Figure 4:
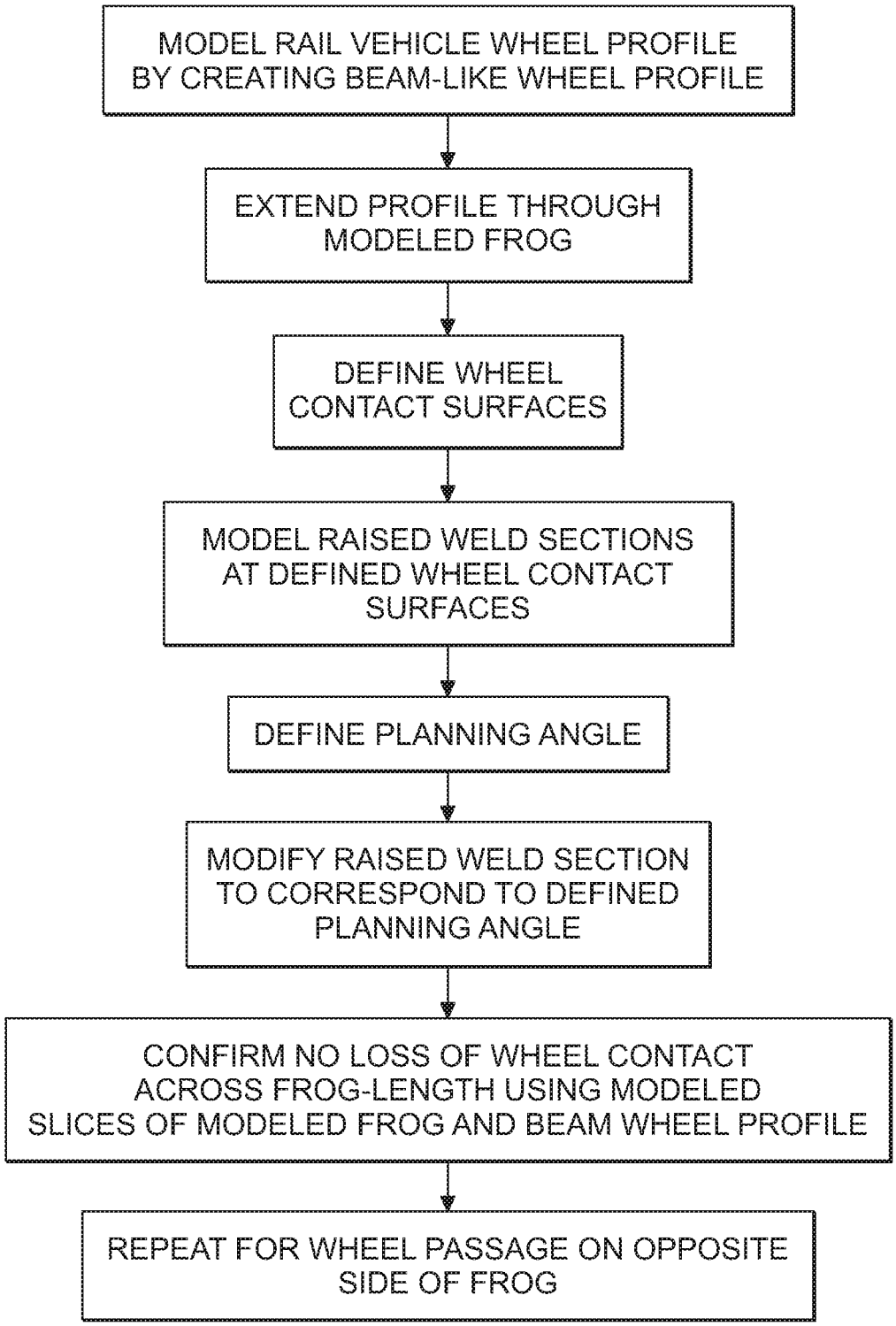
FIG. 4 is a process flow diagram of a frog profile modeling process.

After creating the beam wheel profile 22 and extending it along the length of the frog, the contact areas of the wheel profile 22 on the modeled frog can be defined, as shown in the process flow diagram of FIG. 4 representing the rendering of model 20. At this point, a raised weld section or band is modeled at the previously defined contact areas of the wheel profile 22 on the modeled frog. After reviewing various possible lateral positions of the wheel, then a planing cut angle is defined which is matched to the angle θ of wheel profile 22, and, hence, wheel 1. Hereinafter, because the defined planing cut angle is matched to the angle θ of wheel 1 and modeled wheel profile 22, the wheel angle and planing cut angle will interchangeably be referred to as θ. The modeled raised weld section or band is then modified to correspond to the defined planing cut angle. The beam wheel profile 22 can then be used to confirm that there will be no loss of tread contact along the entire length of the modeled frog from point 14 to wing 16, and onto wing rail 17. Confirmation of no contact loss can be made by, for example, creating and studying modeled lateral "slices" of the modeled frog profile and beam wheel profile 22 along the length of the frog. The above described process can be completed for one side of the modeled frog and then repeated for the opposite side of the modeled frog. The modeled frog profile slices can then be used to machine and assemble inspection templates or plates, which are described in more detail below.

All of the modeling steps described above can be accomplished by any appropriate means, such as by a mechanical modeling software package.

Figure 5A:
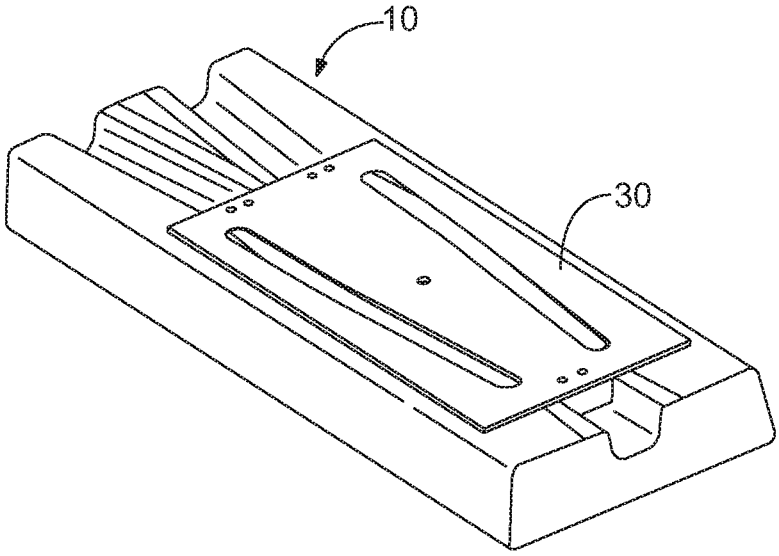
FIG. 5A is a perspective view of a frog and a weld template.
Figure 5B:
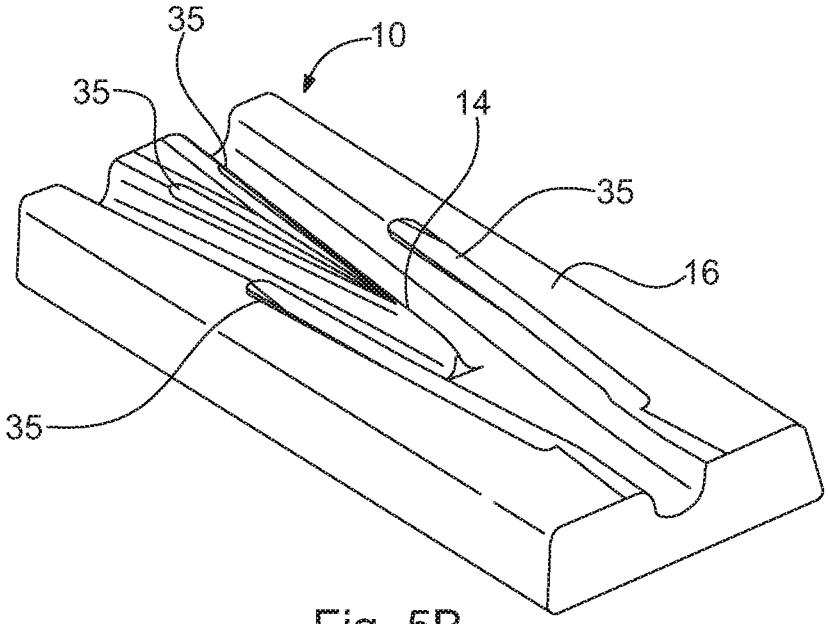
FIG. 5B is a perspective view of a frog showing placement of raised weld sections.

Optionally, a weld template 30 may be manufactured based on the defined contact areas modeled on frog 10, such as that shown in FIG. 5*a*. In use, the weld template 30 can be used for placement of raised weld bands 35, shown in FIG. 5*b*. The raised weld band 35 must be planed at the defined angle θ. In order to properly plane the raised weld band 35, a rail planing or profiling device is necessary. The raised weld bands 35 may be anywhere between 15-50 mm wide from the edge of wings 16 due to the varying width of the defined wheel contact areas of wings 16, which themselves vary in width along their length. The weld bands 35 can be a special high hardness weld material. In practice, there may be regions, along the length of the frog 10, which require distinct weld band heights. These varying heights will be dependent on the particular rail system on which the presently disclosed device and method are employed and will be determined based on the modeling steps described above.

Figure 6:
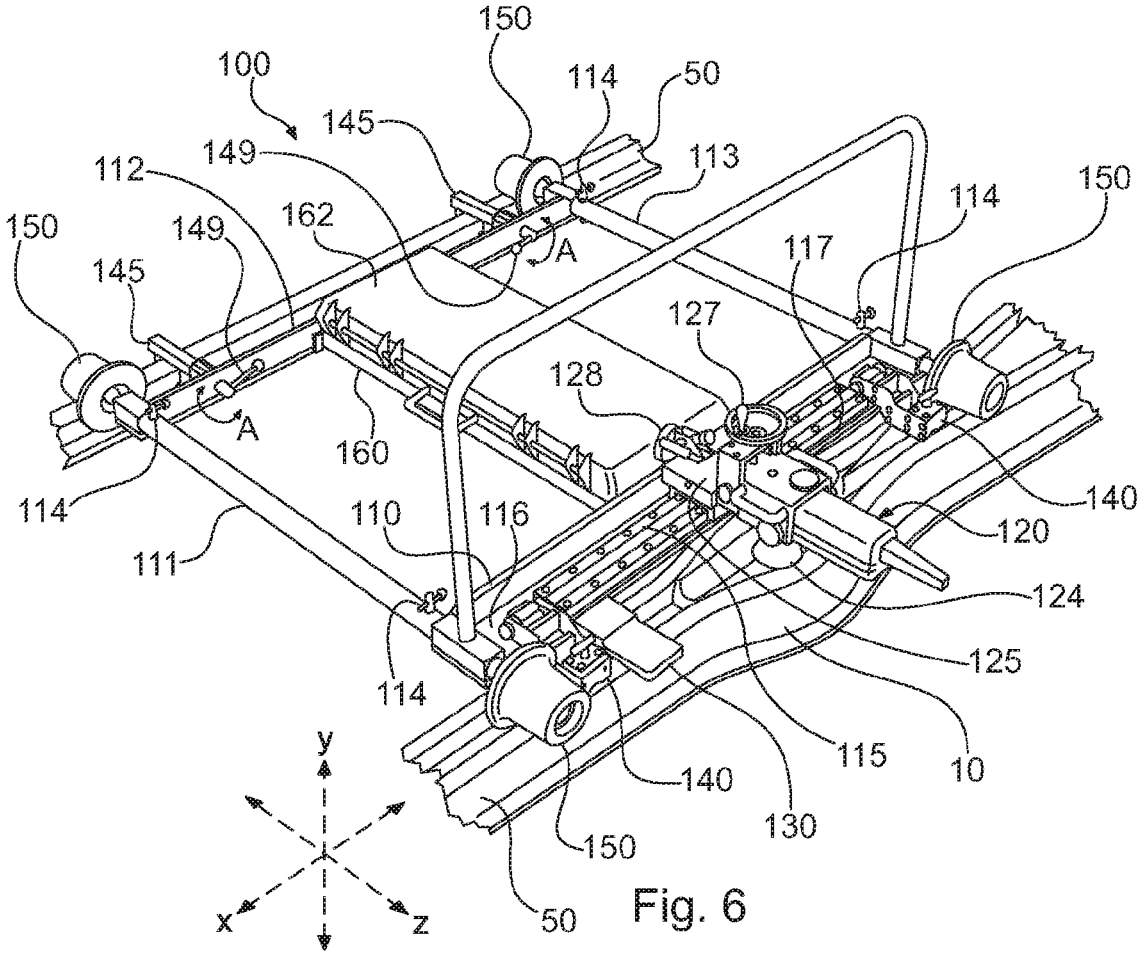
FIG. 6 is a perspective view of a rail crossover profiling device according to the present invention positioned over a rail frog.
Figure 7:
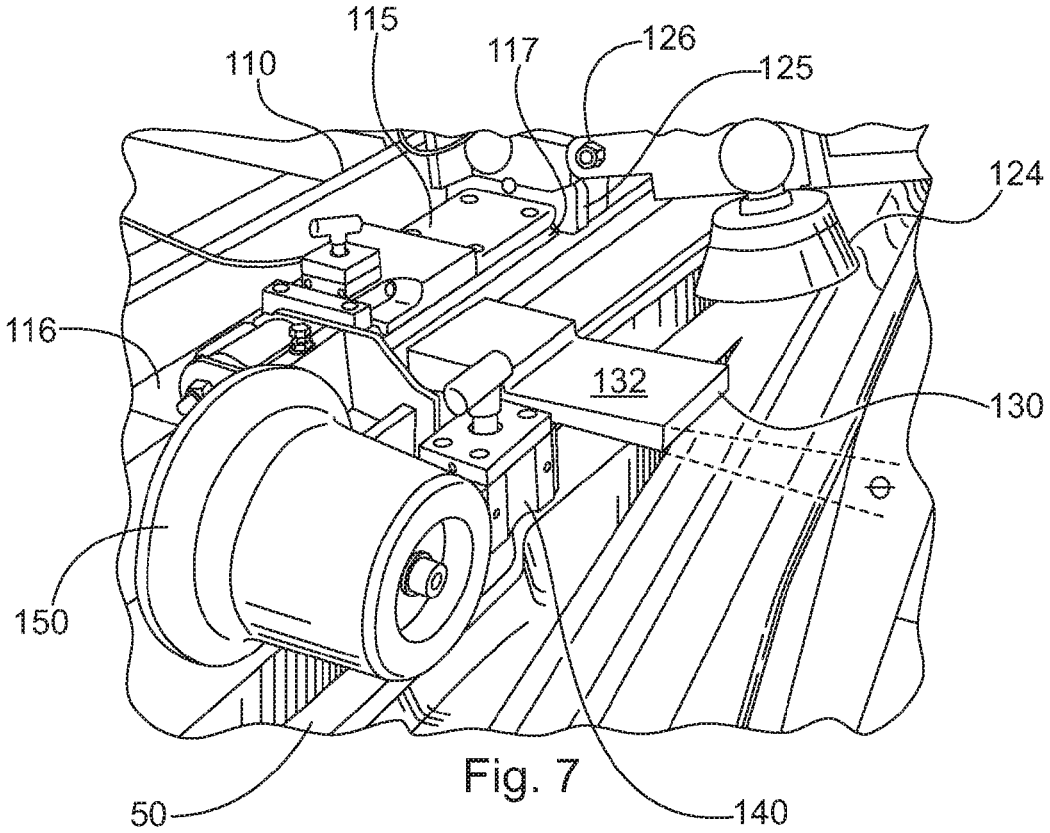
FIG. 7 is an enlarged view of a calibration shoe, planing device, wheel, and wheel lock of the device of FIG. 6.
Figure 8:
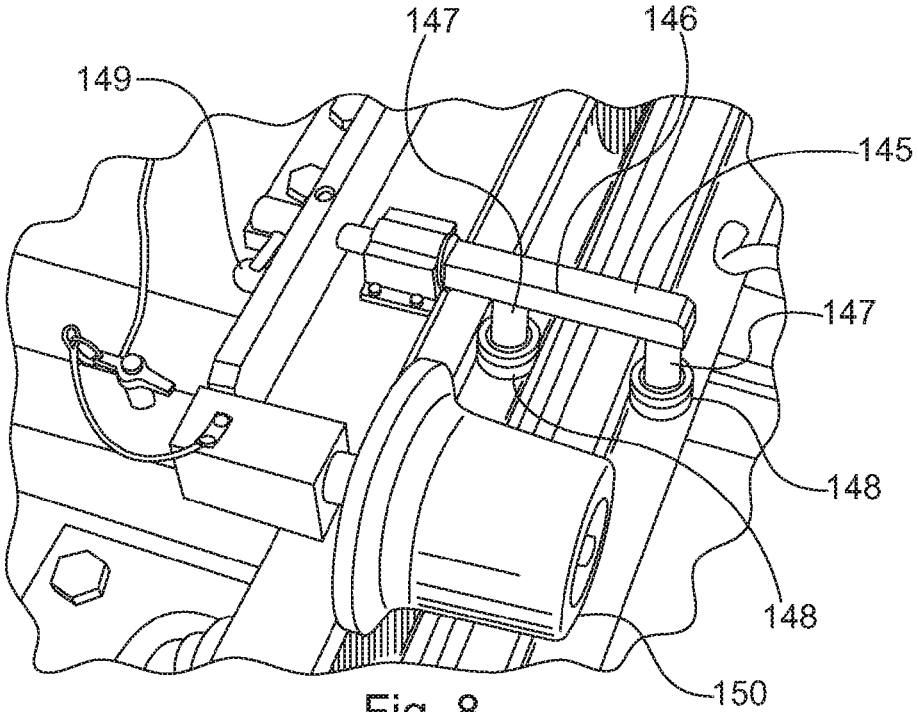
FIG. 8 is an enlarged view of a rail alignment member of the device of FIG. 6.

Referring to FIGS. 6-8, a profiling device 100 may include a frame having two rail-side members 110, 112 which are to be positioned adjacent to laterally spaced rails of a railway. Extending between the rail-side members 110, 112 are two longitudinally spaced support members 111, 113. A plurality of wheels 150 extend from the outside of the rail-side members 110, 112. The device 100 also includes a planing device 120, which may include a grinding head 124, which is explained in detail below, rail locks 140 positioned on rail-side member 110, rail alignment members 145 located on rail-side member 112, and a calibration shoe 130 located on rail-side member 110.

As noted above, the planing device 120, located on rail-side member 110, may include a grinding head 124. The grinding head 124 includes an operation handle 122 and is pivotable with respect to the rail-side member 110. The grinding head 124 includes four degrees of freedom. Three of these degrees of freedom, longitudinal, vertical, and lateral movement, are indicated by the axes shown in FIG. 6 having directional arrows x, y, and z, respectively. The fourth degree of freedom is rotational movement provided by the pivoting relationship between the grinding head 124 and the rail-side member 110. The grinding head 124 may be a replaceable grinding head, such as any commercially available grinding head suitable for grinding metal welding. As shown, rail-side member 110 includes a planar base 116. Positioned on base 116 is a guide rail 115. The guide rail 115 permits movement of the planing device 120 and, therefore, the grinding head 124 longitudinally along rail-side member 110. The guide rail 115, may, for example, take the form of a flanged rail, as shown, having side flangeways 117 for cooperation with a planing device carriage 125. In this manner, carriage 125 will cooperate with flangeways 117 to slide along guide rail 115, thereby, permitting the planing device 120 with grinding head 124 to slide longitudinally along rail-side member 110. The grinding head 124 is pivotally attached to carriage 125 at pivot point 126, thereby providing the rotational movement and fourth degree of freedom, discussed above. In operation, by sliding the grinding head 124 in a longitudinal direction, the device 100 performs a planing operation on a rail crossover, such as steel frog 10, to be profiled. The guide rail 115 may, for example, be between 0.5 and 2 meters in length, such as 1 meter, but may vary depending on the size of the particular frog 10, which is being planed. The planing device 120 also includes a vertical adjustment mechanism 127 and a lateral adjustment mechanism 128 for movement in the vertical and lateral directions.

FIG. 6 shows the device 100 engaged with two laterally spaced rails 50. The wheels 150 of device 100 rest on the rails 50. The support members 111, 113 are located at the ends of the rail-side members 110, 112 and correspond approximately to the location of the axles of wheels 150. As shown, the support members 111, 113 may be adjustable, such that their length can be altered so as to allow wheels 150 to be supported on rails of varying gauges, i.e., the lateral distance between rails. For example, the support members profiling device 100 may include pin locks 114, which lock the support members 111, 113 to rail-side members 110, 112. Upon unlocking of pin locks 114, the support members 111, 113 may be removed and replaced with support members of a different length. However, it is noted that any means of adjusting the length of support members 111, 113 is contemplated for the device 100.

The calibration shoe 130 may extend from rail-side member base 116 of rail-side member 110. The calibration shoe 130 includes a top surface 132 that is sloped at the defined planing angle θ. The top surface 132 of calibration shoe 130 is used for positioning the grinding head 124 at the proper planing angle θ prior to use (explained below).

As shown, the rail locks 140 are positioned on and extend from rail-side member 110. The rail locks 140, in use, secure the device 100 to a railway rail 50 so that the frame of device 100 does not move longitudinally along the rail 50, in the direction of axis x, via wheels 150. The rail locks 140 may, for example, be magnetic rail locks, mechanical rail locks, or any lock capable of securing the device 100 in a longitudinal direction.

The wheels 150 are conically diverging wheels that are shaped to correspond to the wheels 1 of a rail vehicle, i.e., frusto-conically shaped. Therefore, wheels 150 will conically diverge at an angle θ, equal to that of an actual rail vehicle wheel 1 and wheel profile 22. In this manner, the wheels 150 will allow a user of the device 100 to roll the device 100 over the frog 10 to verify the planed angle, which is explained in more detail below. These wheels 150, however, may not be the same size, i.e. have the same radius as, a rail vehicle wheel 1. Wheels 150 may simply have the same cross section profile as a rail vehicle wheel 1, i.e. the same angle of taper θ. The wheels 150 may also be replaceable/removable wheels that are interchangeable with wheels having varying wheel profiles and, consequently, varying angles θ. In this manner, the device 100 may be used for profiling rail crossovers for any particular rail system having a particular rail vehicle wheel profile.

Referring specifically to FIG. 8, rail alignment members 145 are shown in engagement with a rail 50. The rail alignment members 145 include an elongated member 146 having two extensions 147 extending perpendicularly thereto. At least one, and as shown, two guide wheels 148 are located at the ends of extensions 147. As represented by arrows A in FIG. 6, rail alignment members 145 may be rotatable such that they can be positioned in an up position and a downward locked position, the downward locked position being illustrated in FIG. 8. The rail alignment members 145 may be manually rotated via handles located on an opposite side of rail-side member 112. In the downward position, the guide wheels 148 engage the rail 50. The inside extension 147 and guide wheel 148 extend into the flangeway of rail 50, while the outside extension 147 and guide wheel 148 are positioned on the outside of rail 50. In this manner, the alignment members 145 prevent lateral movement of the frame of device 100, when the planing device 120 is in use. The guide wheels 148 and extensions 147 may also be removably engaged with the rail alignment members 145, or alternatively, the rail alignment members 145 may be removably engaged with the rail-side member 112.

Also, as shown in FIG. 6, the device 100 may include a utility platform 160, which could be used for work and/or storage, such as for housing tools and/or other equipment for use in the welding and profiling process. For example, a storage box 162 is shown in FIG. 6 as being stored on platform 160. The platform 160, as illustrated, may extend between and be attached to rail-side members 110, 112.

Prior to use, planing device 120 must be positioned at planing angle θ, defined in the modeling steps described above, so as to plane over the raised weld bands 35, such that the raised weld bands 35 are equal to angle θ, thereby, resulting in no contact loss, when a rail vehicle wheel 1 rolls through frog 10. To obtain the proper planing angle θ, the grinding 124 may be pivoted to planing angle θ via pivot point 126. This may be accomplished by use of the calibration shoe 130.

Figure 9:
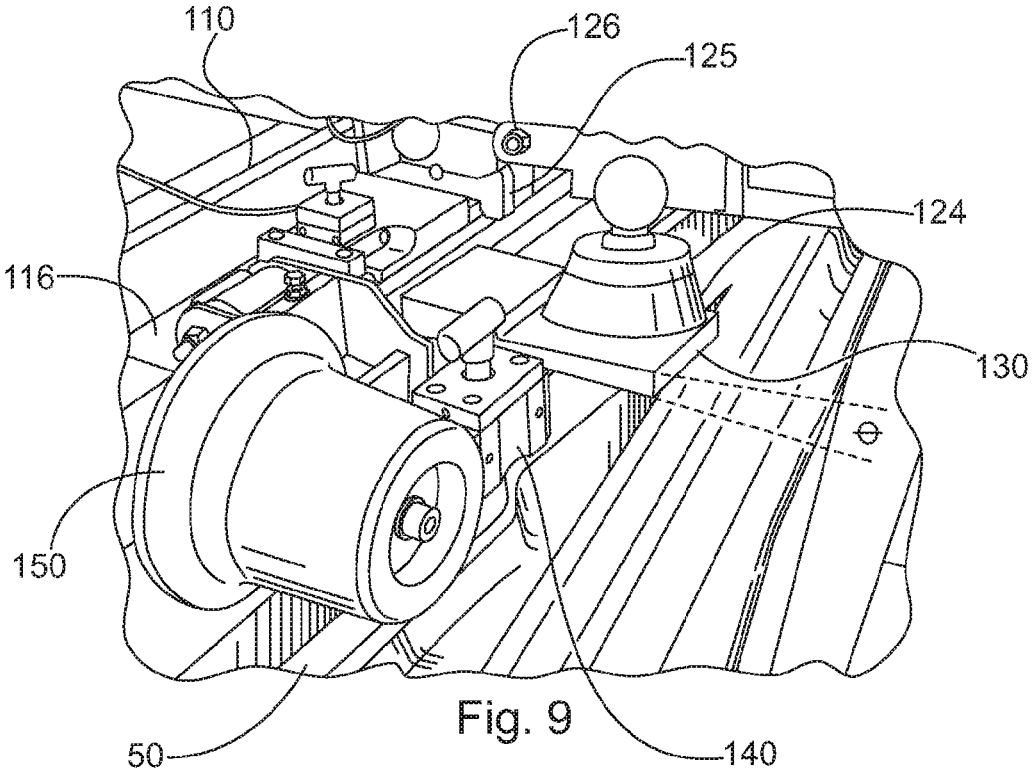
FIG. 9 is a view of the planing device of the device of FIG. 6 positioned over the calibration, prior to use.

Referring to FIG. 9, and as explained above, the calibration shoe 130 extends from rail-side member base 116 of rail-side member 110 and includes a top surface 132 that is sloped at the angle θ. Prior to use, to ensure that the grinding head 124 is positioned at the proper planing angle θ, the grinding head 124 is longitudinally positioned directly over calibration shoe 130. The grinding head 124 is then positioned such that its bottom surface is flush against the top surface 132 of calibration shoe 130. In this manner, the grinding head 124 will be positioned at the planing angle θ. The grinding head 124 may then be used to plane the raised weld bands 35 located on the wings 16 and point 14 of frog 10.

Figure 10:
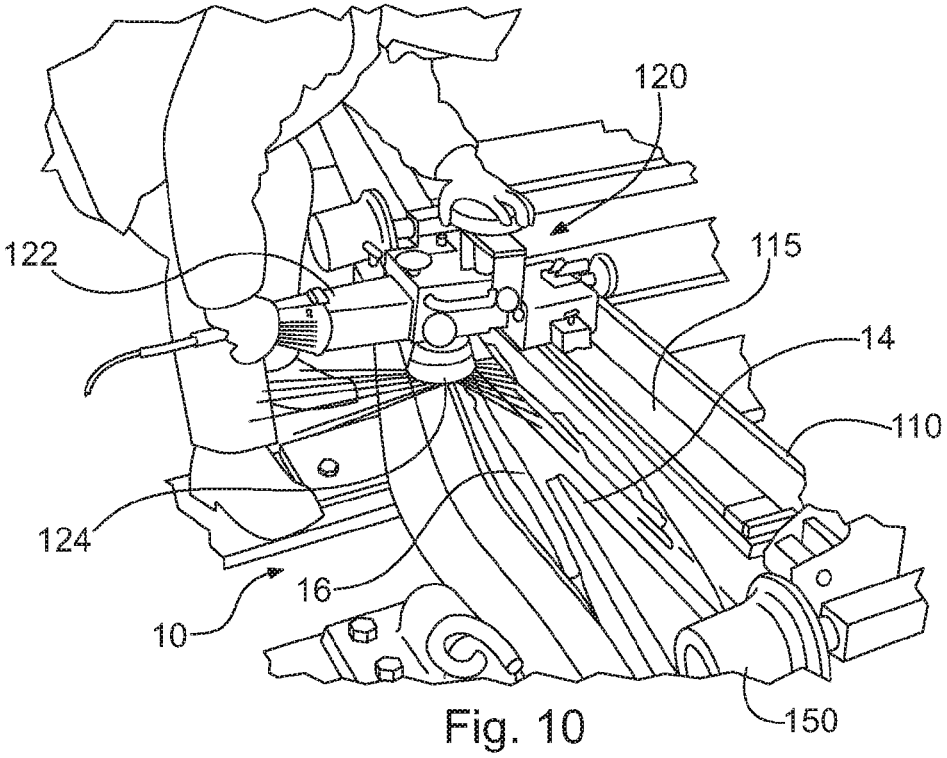
FIG. 10 is a view of the device of FIG. 6 in use.

FIG. 10 shows the device 100 in use, planing the raised weld bands 35 on frog 10. In use, the planing device 120, including planing device carriage 125 and grinding head 124, can be slid along guide rail 115 of rail-side member 110 in the longitudinal direction x. The three degrees of freedom represented by axes x, y, z in FIG. 6 make it possible to plane the entire length of one side of frog 10 in one single set-up pass, including the wing 16, and, optionally, the point 14. What is meant by a single set-up pass is the ability to plane across the length of the frog 10 in one pass of the planing device 120 across guide rail 115 without having to reposition the planing device 120 in order to provide a finished frog profile along one side of the frog, i.e. one of the frog travel paths. After use, the wings 16 and point 14 will include wheel contact surfaces for contact with a rail-vehicle wheel 1, wherein the angle of conical divergence of the wheel and the angle of the contact surfaces will both be equal, i.e., angle θ. In this manner, there will be no contact loss of the wheel 1 along the entire length of the frog 10, as the wheel 1 rolls through frog 10. Optionally, the profiling device 100 may need to be repositioned on rails 50 so as to repeat the above-recited steps on the opposite side of frog 10.

For purposes of verifying that the correct frog profile, as previously modeled, has been achieved after planing, the wheels 150 of device 100 may be used to roll through frog 10. After the planning process is completed, the wheel locks 140 and rail alignment members 145 may be released from rails 50. In this manner, the device 100 can move freely longitudinally along rails 50 via wheels 150 extending from rail-side members 110, 112. If, when rolling the device 100 through frog 10 a level contact loss or drop of wheels 150 from wing 116 of frog 10 is observed, a user can reweld and replane the area of such contact loss using the device 100 with grinding head 124 positioned at angle θ.

Figure 11:
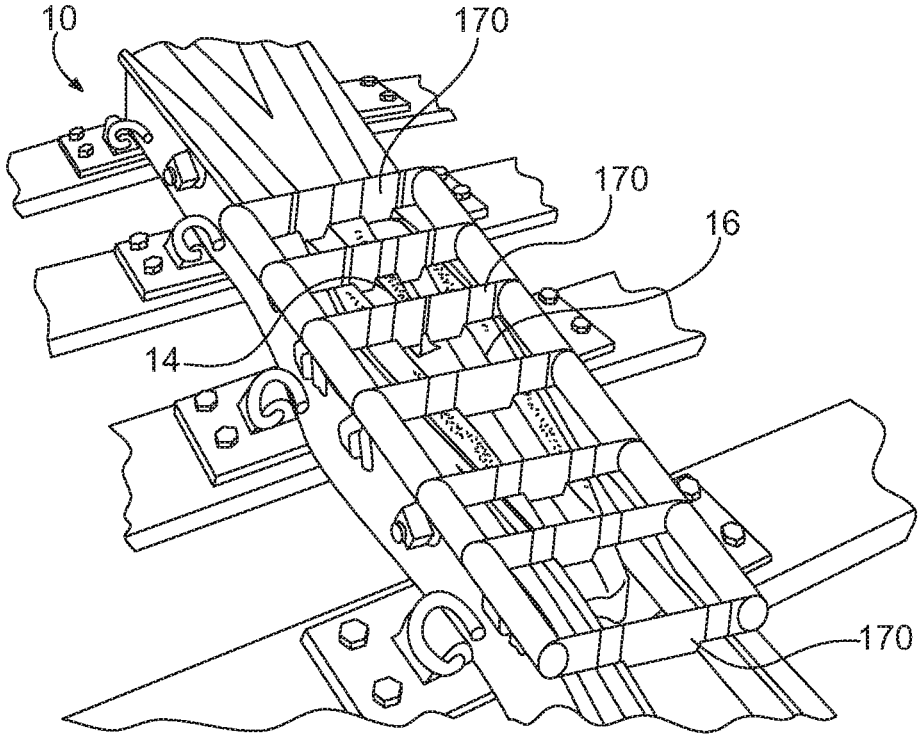
FIG. 11 is a perspective view of a frog having inspection templates positioned thereon after planing of the frog.

Referring now to FIG. 11, another manner of confirming that the correct frog profile has been achieved is by use of a rigid plurality of inspection templates 170. As explained above, these templates 170 can be machined from the modeled frog profile "slices". The templates 170, because they are based on "slices" of the modeled frog having no contact loss, described above, will correspond to the correct frog profile at different points across the length of frog 10. Therefore, after planing using the device 100, the inspection templates 170 can be placed on the surface of frog 10, along its entire length. The number of templates 170 may vary depending on the level of accuracy required. However, five templates 170 are shown here, in FIG. 11, for illustrative purposes only. If the profile of frog 10 is not flush against any of the templates 170, as shown, then contact loss at that particular point would be present and additional rebuild planing required. The inspection plates 170 can conveniently be stored on utility platform 160 so as to maintain all equipment needed for the planing operation in a single place, i.e., on the device 100.

Figure 12:
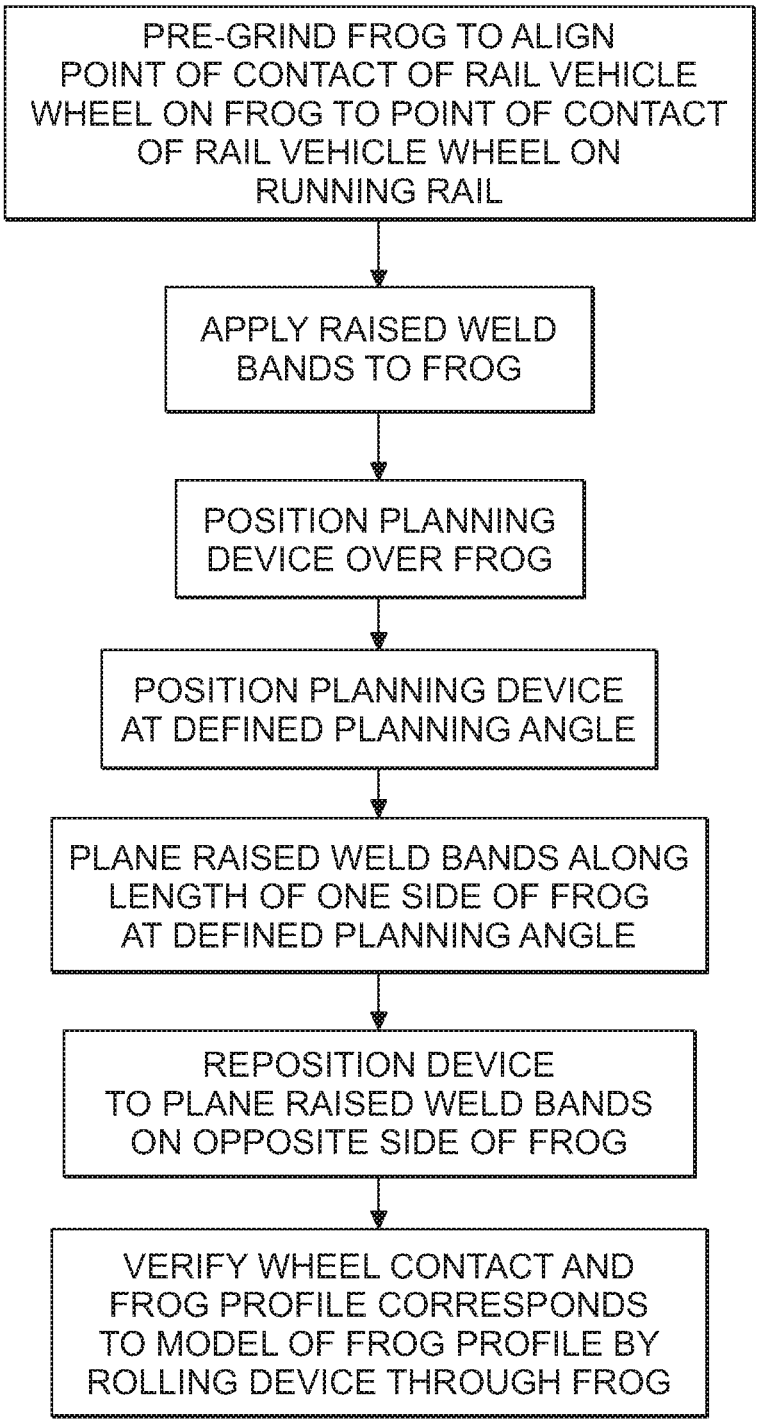
FIG. 12 is a process flow diagram of a method of planing a frog.

The above described planing process is summarized in the process flow diagram of FIG. 12.

Figure 13:
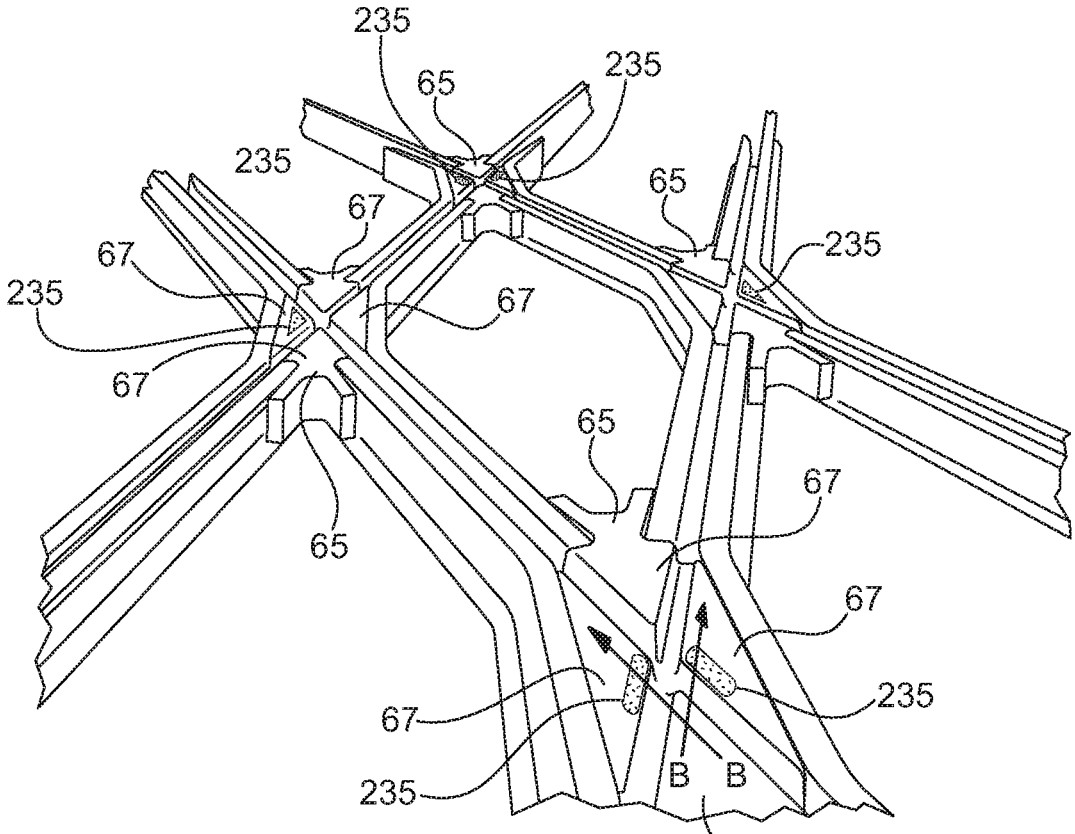
FIG. 13 is a perspective view of a diamond crossing.

The device 100 and process steps described above may be applied to a diamond crossing 60 having crossing inserts 65 with four wing portions each 67, the wing portions 67 acting as either a wing or a point, such as wing 16 and point 14 of frog 10, depending on the direction of travel of the rail vehicle, which is shown in FIG. 13. The arrows B show the direction of travel through diamond crossing 60. The crossing inserts 65 exhibit many of the same issues of wear as do rail frogs, explained above because the crossing inserts 65 are generally not profiled to correspond to the angle of taper θ of rail vehicle wheel 1.

Figure 14:
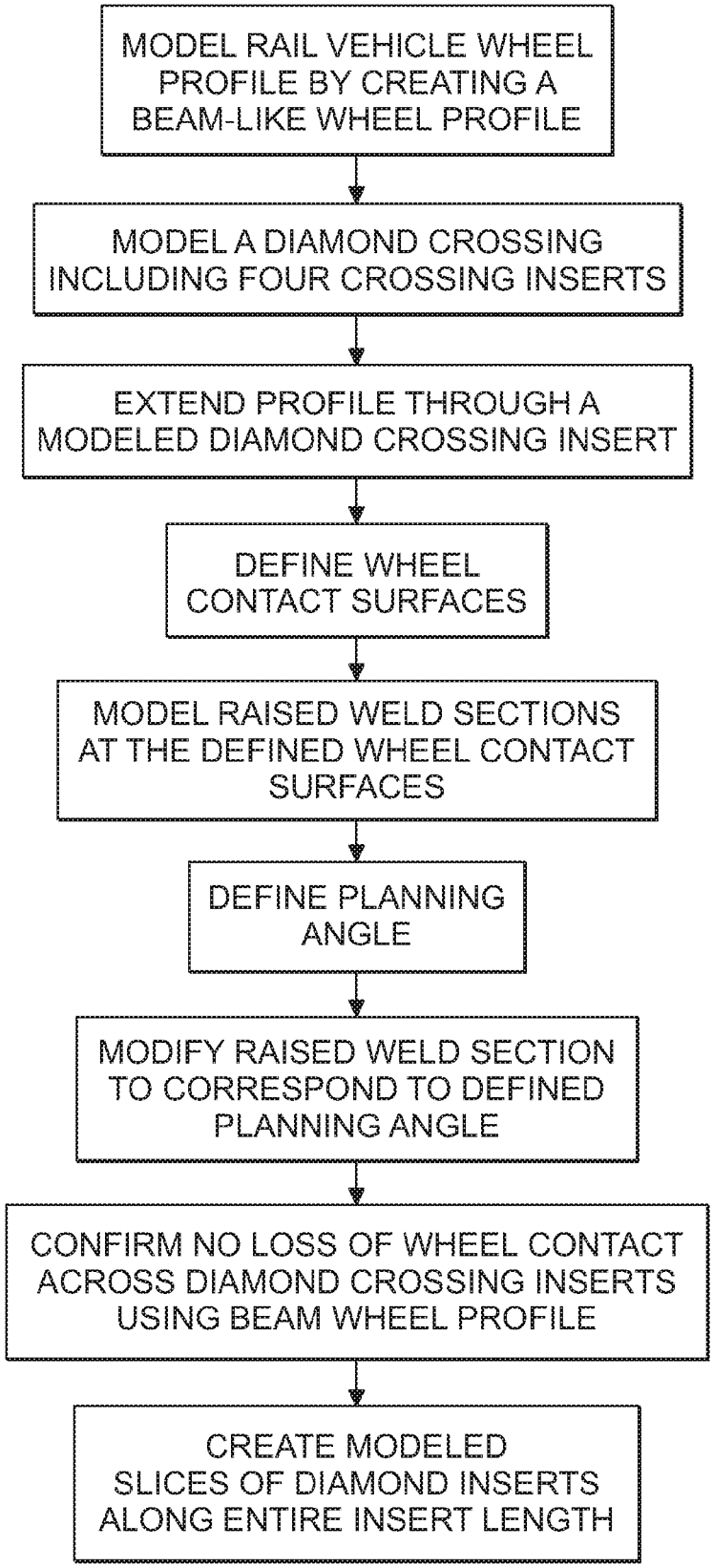
FIG. 14 is a process flow diagram of a diamond crossing modeling process.

Referring to FIG. 14, a process flow diagram shows the modeling steps of generating a model of diamond crossing 60. First, in order to properly determine the correct contact areas of a rail vehicle wheel 1, a modeled diamond crossing may be constructed, such as by three-dimensional surface contour computer modeling, with an extruded beam profile, similarly to the modeled frog described above. Again, the extruded profile would match the angle of taper θ of rail vehicle wheel 1. In this manner, again, the point of contact of wheel 1 across the entire length of each of the four inserts 65 of the diamond crossing 60 in the direction of travel can be examined. The contact areas of the wheel profile on the inserts can then be defined. At this point, a raised weld section or band can also be modeled for the diamond crossing inserts 65 at the defined contact areas. Then the planing cut angle will be defined which is equal to the angle θ of the wheel profile and rail vehicle wheel 1. Again, the modeled raised weld section or band is then modified to correspond to the defined planing cut angle, wherein the beam wheel profile can be used to confirm that there will be no loss of contact along the entire length of the modeled inserts of the diamond crossing. Also, optionally, like above, after confirmation of no contact loss, lateral "slices" of the modeled profile of inserts 65 may be created to manufacture inspection templates.

Also, like above, all of these modeling steps can be accomplished by any appropriate means, such as by a mechanical modeling software package.

Referring back to FIG. 13, raised weld sections 235 can be placed at the defined contact areas from the modeling steps described above. Based on the above modeling steps, the shapes and locations of these raised weld sections 235 shown are merely the preferred positions and shapes, and may vary depending on the particular design of the rail line or diamond crossing being profiled and the results of the modeling steps.

Figure 15:
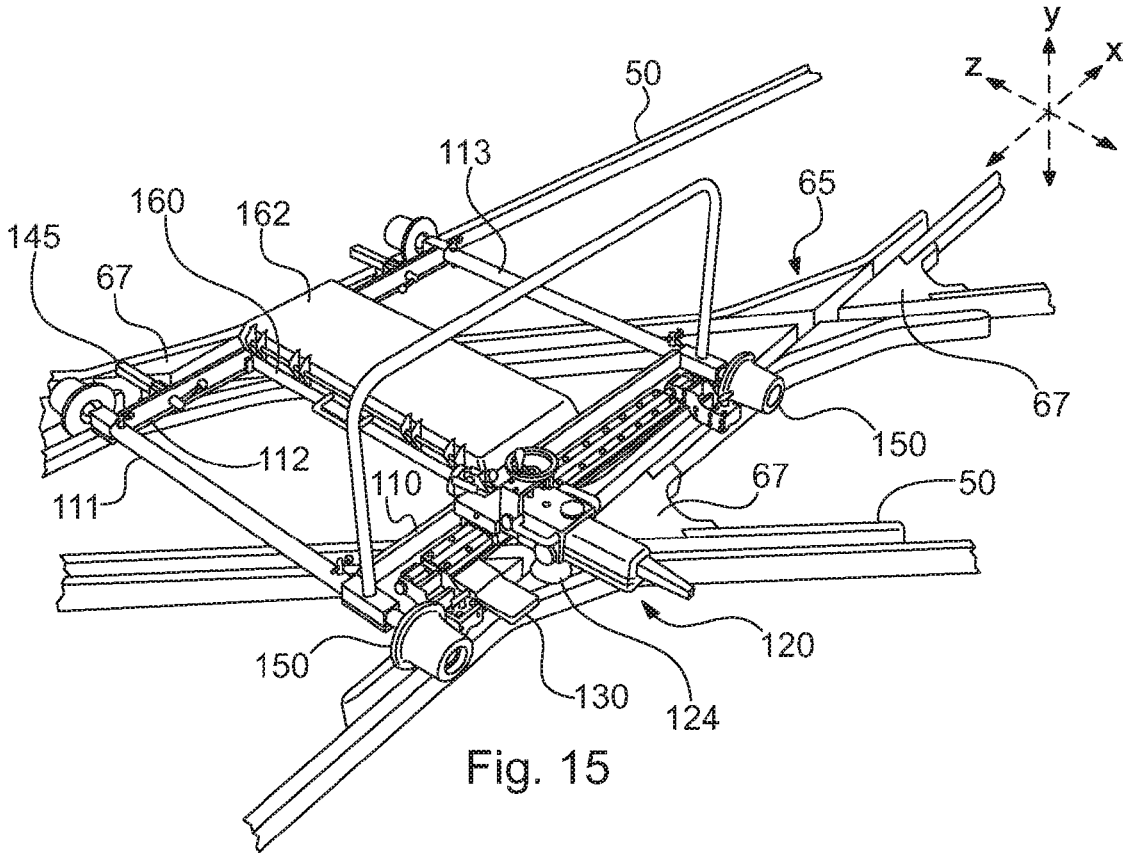
FIG. 15 is a perspective view of the device of a rail crossover profiling device according to the present invention positioned over the diamond crossing of FIG. 14.

Referring to FIG. 15, the device 100 can be positioned on rails 50 of the railway, such that the grinding head 124 is positioned over one of the inserts 65. Similar to the manner in which the device 100 is positioned over frog 10 in FIGS. 6-10, the device 100 can be positioned over the inserts 65 in order to plane the raised weld sections 235. With respect to extensions 147 and guide wheels 148 of rail alignment members 145, when using the device 100 with a diamond crossing 60, the arrangement may require the use of only one guide wheel 148 due to the shape of the diamond crossing, which may only have a single railway rail guide channel present, as opposed to a standard railway rail that can be straddled by guide wheels 148. This arrangement will maintain the precise position of the frame of device 100 within the diamond crossings, and can be easily achieved with the same rail alignment member 145 configuration, as described above with respect to frog 10, if the extensions 147 and guide wheels 148 are removably engaged with rail alignment members 145. The grinding head 124, again, can be positioned against the calibration shoe 130, such that it is flush against top surface 132 of calibration shoe 130, as explained above with respect to FIG. 9, thereby ensuring that the grinding head 124 is positioned at the correct planing angle θ. The grinding head 124 can then be slid along guide rail 115 in the longitudinal direction x to plane the raised weld sections 235. Through the guide rollers located on the adjacent rail side, the device 100 may then have to be repositioned to repeat the planing process over the various raised weld sections 235. That the profile of the insert 65 corresponds to the correct profile of the modeled insert can be verified by rolling the device 100 via wheels 150 through diamond crossing 60 or by using inspection templates, like inspection templates 170, similarly to the verification of the profile of frog 10 described above.

Figure 16:
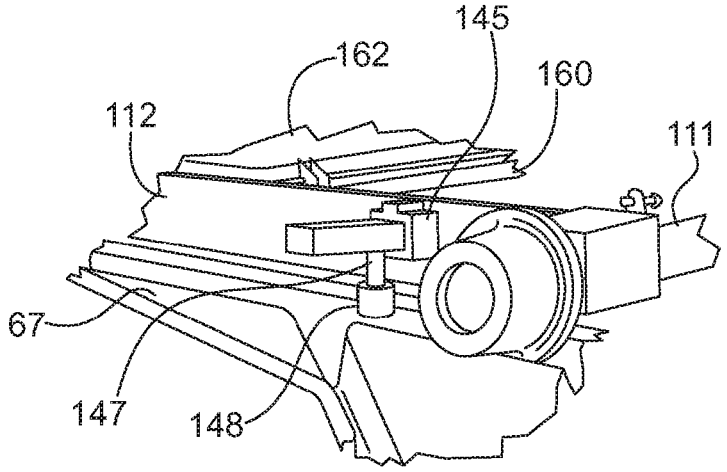
FIG. 16 is an enlarged view of a rail alignment member of the device according to FIG. 15.
Figure 17:
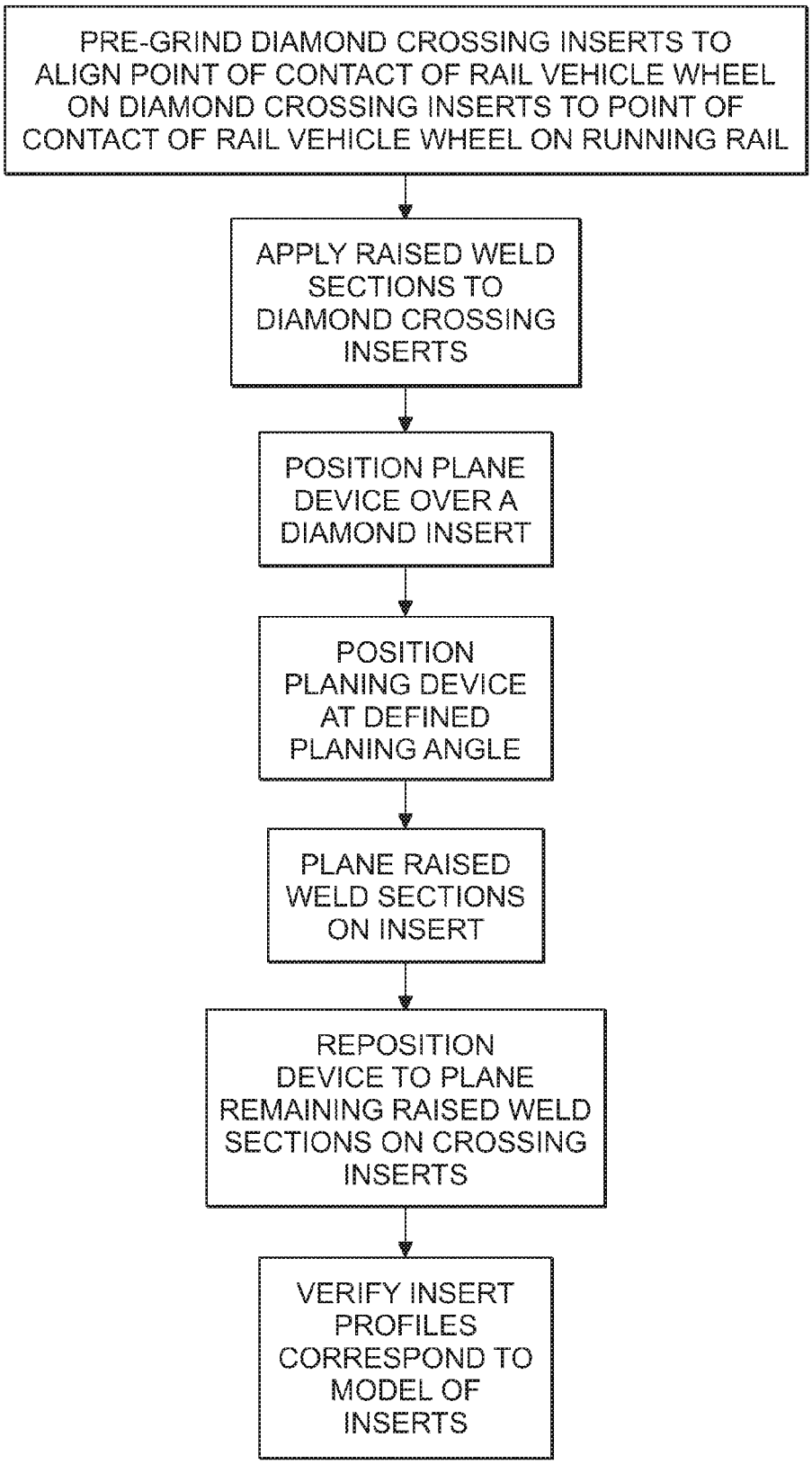
FIG. 17 is a process flow diagram of a method of planing a diamond crossing.
Figure 18:
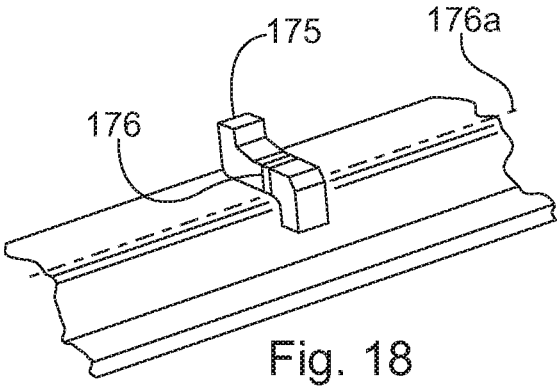
FIG. 18 is a view of a pre-grinding verification gauge.

The diamond crossing planing process is summarized in the process flow diagram of FIG. 16. As the process flow diagrams of FIGS. 16 and 12 indicate, the frog 10 and/or the diamond insert 65 may themselves be pre-ground prior to placement of the weld bands 35 and/or weld sections 235, respectively, which are described above. Generally, the frog 10 or diamond inserts 65 are either flat or worn. In order to maintain a continuously smooth transition into and through the weld bands 35 or weld section 235, which will have a profile angle of θ, the frog 10 and/or diamond insert 65 themselves must be ground to ensure the rail vehicle wheel is positioned properly on the rail just prior to rolling through the planed weld sections 35, 235. This may involve, for example, pre-grinding a flat corner of the frog 10 and/or diamond insert 65 at a position prior to the weld sections 35, 235 in the line of travel such that the point of contact of a vehicle wheel will be shifted on the frog 10 and/or diamond insert 65 to provide an optimal positioning through the frog 10 and/or diamond insert 65. One way of achieving this result, specifically with respect to the frog 10, shown in FIG. 1, is by pre-grinding the heel rail 15 of frog 10, which normally will not include a weld band 35, such that the point of contact of a rail vehicle wheel 1 will align with the point of contact of the wheel 1 on a running rail leading into heel rail 15, such as rails 50 of FIG. 6. A similar step of pre-grinding the throat 12 of the frog 10 to align the point of contact of the wheel 1 with the running rail leading out of the throat 12 may be performed. This also may involve modeling the travel of wheel 1 on the rail 50 prior to and after the frog 10 and/or diamond insert 65. Verification that sufficient pre-grinding of the frog 10 and/or diamond insert 65 has occurred can be completed by means of a gauge, such as a gauge 175 having indicia 176 marked thereon to verify the width of material removed from the frog 10 and/or diamond insert 65 which corresponds to a wheel contact area indicated by line 176*a*, shown in FIG. 18.

Figure 19:
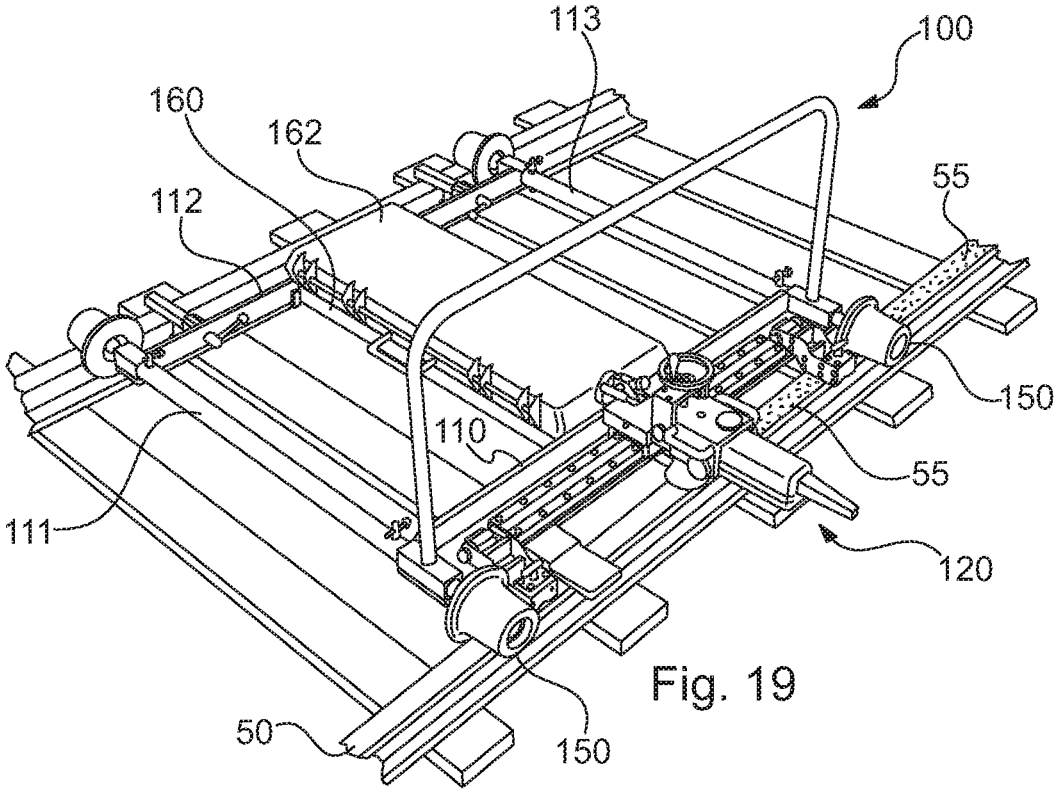
FIG. 19 is a perspective view of a rail crossover profiling device according to the present invention positioned over railway rails to remove rail corrugation.

Referring to FIG. 19, the device 100 can also be used to remove rail surface corrugation 55, which may be present on straight sections of rails 50, or within a crossover.

Figure 20:
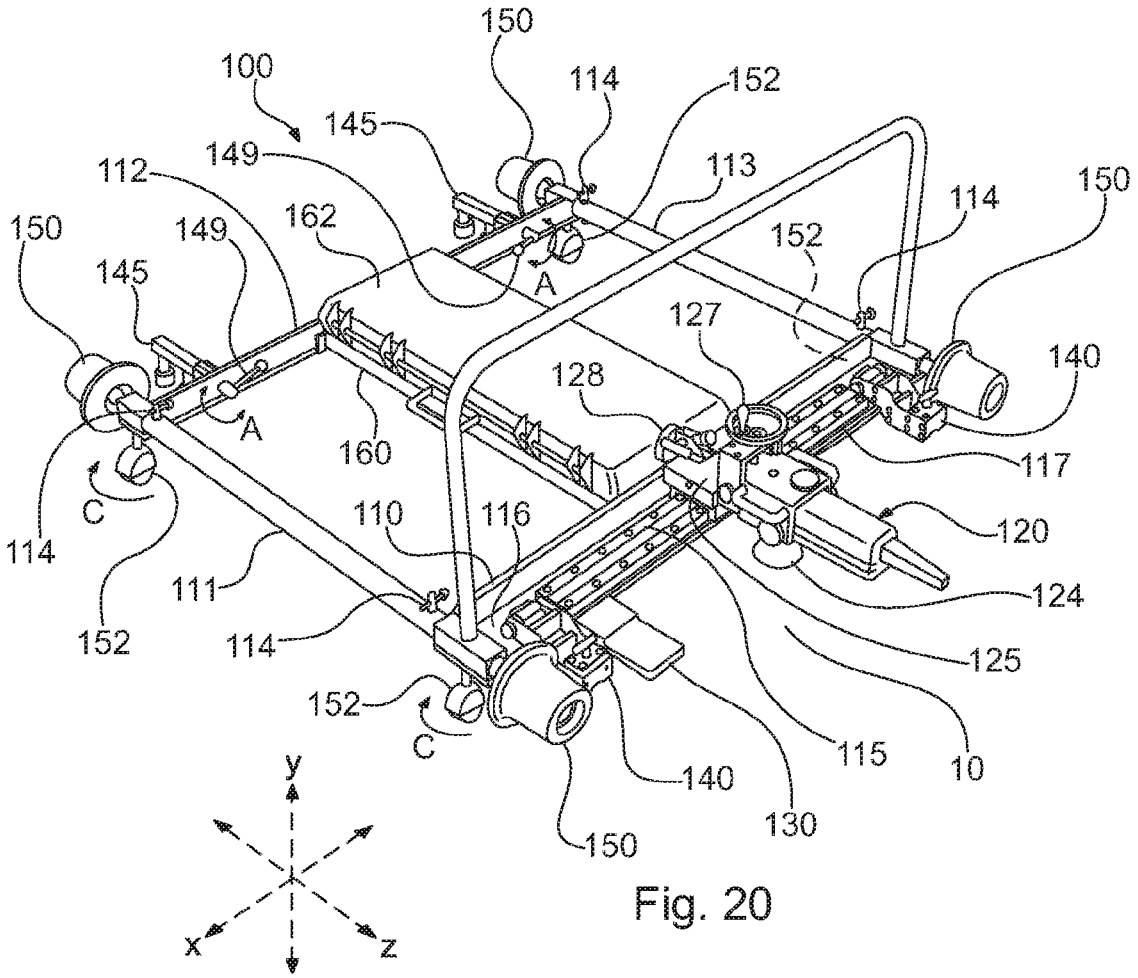
FIG. 20 is a perspective view of a rail crossover profiling device according to the present invention including transportation guide wheels.

Lastly, referring to FIG. 20, the device 100 may include transportation guide wheels 152 located on the frame, such as at corners of rail-side members 110, 112. The transportation guide wheels 152 can be used for transporting the device over a surface, such as roadways and other hard surfaces before and after use of the device 100. In use, the transportation guide wheels 152, which could be caster wheels, can be positioned under the frame, such that the device 100 can be rolled from location to location. The transportation guide wheels 152 could be attached to the frame of the device 100 in any manner, for example, removably, permanently, or pivotably about the frame of the device 100, so long as they do not interfere with normal operation of the device and can be positioned under the frame to facilitate transport. As illustrated, the transportation guide wheels 152 are pivotable about the frame from an up horizontal position, to a down vertical position, as indicated by arrows C. The transportation guide wheels 152 are shown in the down position to facilitate transportation, and could subsequently be pivoted to the up position for use of the device 100.

By using the above-described methods and device, tremendous time, money, and manpower can be saved in the repair of rail crossovers, such as steel frogs and diamond crossings. The installation of brand new, expensive, custom profile-matched crossovers can be avoided. Existing crossovers can be efficiently profile-matched to the particular rail vehicle wheels with which the crossovers are associated without resorting to new installations. Profile-matching existing crossovers results in extended life of the crossover, thereby, minimizing damage to the crossover and, therefore, cost of maintenance.

While several embodiments of methods of profile-matching rail crossovers to rail vehicle wheels and a device therefore that has been described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A rail profiling device for a railway crossover on which travels a rail vehicle having wheels with a frusto-conical profile having a profile angle conically diverging, the frusto-conical wheels substantially having an off-center point of contact with rails of the railway, the rail profiling device for planing a raised weld area on the railway crossover and comprising:

a frame having a first rail-side member and a second rail-side member laterally spaced from each other;

a plurality of wheels connected to the frame, the plurality of wheels being arranged on opposite rail-side members and spaced a distance between each other such that the wheels are configured to be mounted on laterally spaced rails of the railway, such that the distance between wheels of opposite rail-side members is equivalent to an axle width of the rail vehicle of the railway, the frame wheels having a frusto-conical wheel profile conically diverging at substantially the profile angle, and a planing device positioned on the first rail-side member to plane the raised weld area on the crossover to provide a crossover wheel contact surface profile along the entire length of one side of the railway crossover, the wheel contact surface profile being planed according to the profile angle of the rail vehicle wheels, wherein the frame wheels substantially have the same off-center point of contact with the rails of the railway as the point of contact of the wheels of the rail vehicle.

2. The rail profiling device of claim 1, wherein the planing device is pivotable with respect to the first rail-side member.

3. The rail profiling device of claim 2, further comprising a calibration shoe extending from the first side-rail member and positioned at the profile angle, wherein, prior to operation, the planing device is configured to be positioned over the calibration shoe to pivot the planing device at an angle equal to the calibration shoe angle.

4. The rail profiling device of claim 2, wherein the planing device comprises a grinding head.

5. The rail profiling device of claim 4, wherein the grinding head is detachably connected to the planing device.

6. The rail profiling device of claim 5, wherein the planing device is adapted to receive a replacement grinding head.

7. The rail profiling device of claim 1, wherein the planing device is moveable in a plurality of degrees of freedom with respect to the frame.

8. The rail profiling device of claim 7, wherein the planing device is moveable in four degrees of freedom with respect to the frame.

9. The rail profiling device of claim 8, wherein the four degrees of freedom include lateral movement, longitudinal movement, vertical movement and rotational movement.

10. The rail profiling device of claim 1, further comprising a guide rail positioned on the first rail-side member, the planing device being positioned in slidable engagement with the guide rail, wherein, in operation, the planing device can slide longitudinally along the guide rail.

11. The rail profiling device of claim 10, wherein the guide rail is at least 0.5 meter in length.

12. The rail profiling device of claim 1, further comprising two longitudinally spaced support members, the support members being adjustable such that the wheels are configured to be mounted on laterally spaced rails of varying gauges.

13. The rail profiling device of claim 1, further comprising rail locks positioned on the first rail-side member to lock the frame to the railway rails.

14. The rail profiling device of claim 12, further comprising a utility platform positioned between the rail-side members.

15. The rail profiling device of claim 1, further comprising rail alignment members extending from the second rail-side member.

16. The rail profiling device of claim 15, wherein the rail alignment members comprise an elongated body having two extensions positioned perpendicularly thereto, the extensions having at least one guide wheel attached thereto, the rail alignment member being rotatable from an upward position to downward locked position, wherein the extensions and guide wheel are adapted to maintain the frame in a lateral position.

17. The rail profiling device of claim 16, wherein the extensions have two guide wheels attached thereto adapted to straddle a portion of the railway rail.

18. The rail profiling device of claim 1, wherein the plurality of wheels comprise removable wheels interchangeable with wheels of varying wheel profiles.

19. The rail profiling device of claim 1, further comprising a plurality of caster guide wheels attached to the frame, wherein, when the frame is disengaged with a railway rail, the caster guide wheels are configured to transport the frame across a surface.

20. The rail profiling device of claim 19, wherein the caster guide wheels are pivotable about the frame.

21. The rail profiling device of claim 1, wherein the plurality of wheels comprises a pair of wheels on each of the first and second rail-side members.

22. The rail profiling device of claim 1, wherein the frame wheels are selected as a set based on the profile angle of the rail vehicle wheels.

23. A rail profiling device for a railway crossover on which travels a rail vehicle having wheels with a frusto-conical profile having a profile angle conically diverging, the frusto-conical wheels substantially having off-center point of contact with rails of the railway, the rail profiling device for planing a raised weld area on the railway crossover and comprising:

a frame having a first rail-side member and a second rail-side member laterally spaced from each other;

a plurality of wheels attached to the frame, the plurality of wheels being arranged on opposite rail-side members and spaced a distance between each other such that the wheels are configured to be mounted on laterally spaced rails of the railway corresponding to an axle width of a rail vehicle of the railway, the wheels comprising a wheel profile corresponding to a wheel profile of the rail vehicle, such that the frame wheels substantially have the same off-center point of contact with the rails of the railway as the point of contact of the wheels of the rail vehicle; and a planing device positioned on the first rail-side member and moveable in a plurality of degrees of freedom with respect to the frame, to plane the raised weld area on the crossover to provide a crossover wheel contact surface profile along the entire length of one side of the railway crossover, the wheel contact surface profile being planed according to the rail vehicle wheel profile angle.

24. The rail profiling device of claim 23, wherein the planing device is moveable in four degrees of freedom with respect to the frame.

25. The rail profiling device of claim 23, wherein the plurality of wheels comprises a pair of wheels on each of the first and second rail-side members.

* * * * *